US006464337B2

(12) United States Patent
Roy et al.

(10) Patent No.: US 6,464,337 B2
(45) Date of Patent: Oct. 15, 2002

(54) APPARATUS AND METHOD FOR ACOUSTIC INK PRINTING USING A BILAYER PRINTHEAD CONFIGURATION

(75) Inventors: Joy Roy, San Jose; Scott A. Elrod, La Honda; Donald L. Smith, Bolinas; Jerry Elkin, Georgetown; John S. Fitch, Los Altos, all of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/773,350

(22) Filed: Jan. 31, 2001

(65) Prior Publication Data

US 2002/0101478 A1 Aug. 1, 2002

(51) Int. Cl.[7] ..... B41J 2/135
(52) U.S. Cl. ..... 347/46; 347/18
(58) Field of Search ..... 347/46, 18

(56) References Cited

U.S. PATENT DOCUMENTS

| | | | | |
|---|---|---|---|---|
| 5,017,941 A | | 5/1991 | Drake | 346/1.1 |
| 5,389,956 A | | 2/1995 | Hadimioglu et al. | 347/46 |
| 5,565,113 A | | 10/1996 | Hadimioglu et al. | 347/46 |
| 5,591,490 A | * | 1/1997 | Quate | 347/46 |
| 5,631,676 A | * | 5/1997 | Karz | 347/18 |
| 5,786,722 A | | 7/1998 | Buhler et al. | 347/46 |
| 6,134,291 A | | 10/2000 | Roy et al. | 347/46 |
| 6,154,236 A | | 11/2000 | Roy et al. | 347/46 |
| 6,199,970 B1 | * | 3/2001 | Roy et al. | 347/46 |
| 6,283,580 B1 | * | 9/2001 | Roy et al. | 347/46 |

FOREIGN PATENT DOCUMENTS

| | | |
|---|---|---|
| JP | 61106270 | 5/1986 |

* cited by examiner

*Primary Examiner*—John Barlow
*Assistant Examiner*—Julian D. Huffman
(74) *Attorney, Agent, or Firm*—Fay, Sharpe, Fagan, Minnich & McKee, LLP

(57) ABSTRACT

This invention relates to a method and apparatus for acoustic ink printing using a bilayer configuration. More particularly, the invention concerns an acoustically actuated droplet emitter which is provided with a continuous, high velocity, laminar flow of cooling liquid in addition to a stagnant pool of liquid to be emitted as droplets.

15 Claims, 10 Drawing Sheets

APPARATUS AND METHOD FOR ACOUSTIC INK PRINTING USING A BILAYER PRINTHEAD CONFIGURATION

BACKGROUND OF THE INVENTION

This invention relates to a method and apparatus for acoustic ink printing using a bilayer configuration. More particularly, the invention concerns an acoustically actuated droplet emitter device which is provided with a continuous, high velocity, laminar flow of cooling liquid in addition to a stagnant pool of liquid to be emitted as droplets.

While the invention is particularly directed to the art of acoustic ink printing, and will be thus described with specific reference thereto, it will be appreciated that the invention may have usefulness in other fields and applications. For example, the invention may be used in other acoustic wave generators wherein other types of fluid such as molten metal, etc. are emitted using an array of emitters.

By way of background, acoustic droplet emitters are known in the art and use focussed acoustic energy to emit droplets of fluid. Acoustic droplet emitters are useful in a variety of applications due to the wide range of fluids that can be emitted as droplets. For instance, if marking fluids are used the acoustic droplet emitter can be employed as a printhead in a printer. Acoustic droplet emitters do not use nozzles, which are prone to clogging, to control droplet size and volume, and many other fluids may also be used in an acoustic droplet emitter making it useful for a variety of applications. For instance, it is stated in U.S. Pat. No. 5,565,113 issued Oct. 15, 1996 by Hadimioglu et al. titled "Lithographically Defined Ejection Units" and incorporated by reference herein, that mylar catalysts, molten solder, hot melt waxes, color filter materials, resists and chemical and biological compounds are all feasible materials to be used in an acoustic droplet emitter.

One issue when using high-viscosity fluids in an acoustic droplet emitter is the high attenuation of acoustic energy in high-viscosity fluids. High attenuation rates may therefore require larger amounts of acoustic power to achieve droplet emission from high-viscosity fluids. One solution to this problem has been shown in U.S. Pat. No. 5,565,113 issued Oct. 15, 1996 by Hadimioglu et al. titled "Lithographically Defined Ejection Units" and incorporated by reference hereinabove and is shown in FIG. 1.

FIG. 1 shows a cross-sectional view of an individual droplet emitter 10 for an acoustically actuated printer such as is shown in U.S. Pat. No. 5,565,113 by Hadimioglu et al. titled "Lithographically Defined Ejection Units" and incorporated by reference hereinabove. The droplet emitter 10 has a base substrate 12 with a transducer 16 interposed between two electrodes 17 on one surface and an acoustic lens 14 on an opposite surface. Attached to the same side of the base substrate 12 as the acoustic lens is a top support 18 with a liquid cell 22, defined by sidewalls 20, which holds a low attenuation liquid 23. Supported by the top support 18 is an acoustically thin capping structure 26 which forms the top surface of the liquid cell 22 and seals in the low attenuation liquid 23.

The droplet emitter 10 further includes a reservoir 24, located over the acoustically thin capping structure 26, which holds emission fluid 32. As shown in FIG. 1, the reservoir 24 includes an aperture 30 defined by sidewalls 34. The sidewalls 34 include a plurality of portholes 36 through which the emission fluid 32 passes. A pressure means forces the emission fluid 32 through the portholes 36 so as to create a pool of emission fluid 32 having a free surface 28 over the acoustically thin capping structure 26.

The transducer 16, acoustic lens 14, and aperture 30 are all axially aligned such that an acoustic wave produced by the transducer 16 will be focussed by its aligned acoustic lens 14 at approximately the free surface 28 of the emission fluid 32 in its aligned aperture 30. When sufficient power is obtained, a mound 38 is formed and a droplet 39 is emitted from the mound 38. The acoustic energy readily passes through the acoustically thin capping structure 26 and the low attenuation liquid 23. By maintaining only a very thin pool of emission fluid 32 acoustic energy loss due to the high attenuation rate of the emission fluid 32 is minimized.

FIG. 2 shows a perspective view of two arrays of the droplet emitter 10 shown in FIG. 1. The arrays 31 of apertures 30 can be clearly above the two reservoirs 24. Each array 31 has a width W and a length L where the length L of the array 24 is the larger of the two dimensions. Having arrays of droplet emitters 10 is useful, for instance, to enable a color printing application where each array might be associated with a different colored ink. This configuration of the arrays allows for accurate location of each individual droplet emitter 10 and precise alignment of the arrays 31 relative to each other which increases, among other things droplet placement accuracy.

However, the low attenuation liquid 23, the emission fluid 32, and the substrate 12 will heat up from the portion of the acoustic energy that is absorbed in the low attenuation liquid 23, the emission fluid 32, and the substrate 12 which is not transferred to the kinetic and surface energy of the emitted drops 39. This will in turn cause excess heating of the emission fluid 32. The emission fluid 32 can sustain temperature increases by only a few degrees centigrade before emitted droplets show drop misplacement on the receiving media. In a worst case scenario, the low attenuation liquid 23 can absorb enough energy to cause it to boil and to destroy the droplet emitter 10. The practical consequences of this are that the emission speed must be kept very slow to prevent the low attenuation liquid 23 from absorbing too much excess energy in a short time period and heating up to unacceptable levels.

Therefore, it would be highly desirable if a droplet emitter 10 could be designed to operate while maintaining a uniform thermal operating temperature at high emission speeds. One such prior approach is described in U.S. Pat. No. 6,134,291, filed Jul. 23, 1999 (and issued Oct. 17, 2000) and entitled "An Acoustic Ink Jet Printhead Design and Method of Operation Utilizing Flowing Coolant and an Emission Fluid," which is incorporated herein by reference.

As described therein, turning now to FIG. 3, there is shown a cross-sectional view of a droplet emitter 40. The droplet emitter 40 has a base substrate 42 with transducers 46 on one surface and acoustic lenses 44 on an opposite surface. Spaced from the base substrate 42 is an acoustically thin capping structure 50. The acoustically thin capping structure 50 may be either a rigid structure made from, for example, silicon, or a membrane structure made from, for example, parylene, mylar, or kapton. In order to preserve the acoustic transmission properties the acoustically thin capping structure 50 should preferably have either a very thin thickness such as approximately $1/10^{th}$ of the wavelength of the transmitted acoustic energy in the membrane material or a thickness substantially equal to a multiple of one-half the wavelength of the transmitted acoustic energy in the membrane material. Whether the acoustically thin capping structure 50 is made from a rigid material or a membrane it will structurally be relatively thin and have a tendency to be fragile and susceptible to breakage. To provide additional stability for the acoustically thin capping structure 50 it is supported by a capping structure support 51. The capping structure support 51 is interposed between the base substrate 42 and the acoustically thin capping structure 50, adjacent to the acoustically thin capping structure 50 and spaced from the base substrate 42. The capping structure support 51 has a series of spaced apart apertures 49, positioned in a like manner to lens array 44, so that focussed acoustic energy may pass by the capping structure support 51 substantially unimpeded. The apertures 49 have a capping structure support aperture diameter $d_1$. The addition of the capping structure support 51 allows for a wider variety of materials to be used as the acoustically thin capping structure 50 and adds strength and stability to the acoustically thin capping structure 50.

The chamber created by the space between the base substrate 42 and the acoustically thin capping structure 50 is filled with a low attenuation fluid 52. The chamber could be filled with the low attenuation fluid 52 and sealed as described hereinabove with respect to FIG. 1, however, benefits can be achieved if the chamber is not sealed and the low attenuation fluid 52 is allowed to flow through the chamber. FIG. 3 shows a flow direction of the low attenuation fluid $F_2$ which is orthogonal to the plane of the drawing and out of the plane of the drawing. However, while a droplet emitter 40 which has a flow direction of the low attenuation fluid $F_2$ in this direction may possibly be the easiest to construct, other flow directions are possible and may even in some circumstances be preferable. For instance, the droplet emitter 40 could also be constructed such that the flow direction of the low attenuation fluid $F_2$ was flowing in the plane of the drawing in either a "right" or "left" direction.

Flowing the low attenuation liquid 52 enables the low attenuation liquid 52 to help maintain thermal uniformity of the droplet emitter 40. In particular, not only does the low attenuation liquid 52 itself have less opportunity to heat up due to excess heat generated during the acoustic emission process but because the low attenuation liquid 52 is in thermal contact with the substrate 42 the low attenuation liquid 52 may also absorb excess heat generated in the substrate 42 during operation and prevent excess heating of the substrate 42 as well. Further, it can be appreciated that this structure of a thin capping structure over a relatively rigid capping support creates a fluidically sealed flow chamber enabling relatively high flow rates of the low attenuation fluid without changing the position of the capping structure with respect to the focussed acoustic beam. Consequently, rapid removal of excess generated heat and temperature uniformity is achieved.

Spaced from the acoustically thin capping structure 50 is a liquid level control plate 56. The acoustically thin capping structure 50 and the liquid level control plate 56 define a channel which holds an emission fluid 48. The liquid level control plate 56 contains an array 54 of apertures 60. The transducers 46, acoustic lenses 44, apertures 49 and apertures 60 are all axially aligned such that an acoustic wave produced by a single transducer 46 will be focussed by its aligned acoustic lens 44 at approximately a free surface 58 of the emission fluid 48 in its aligned aperture 60. When sufficient power is obtained, a droplet is emitted. It should be noted that the apertures 60 in the liquid level control plate 56 have a liquid level control plate aperture diameter $d_2$. In order to insure that the acoustic wave produced by a transducer will propagate substantially unimpeded through the aperture 49 in the capping structure support aperture diameter $d_1$ should be larger than the diameter of the acoustic beam as it passes through the aperture 49.

FIG. 4 shows a perspective view of the droplet emitter 40 shown in FIG. 3. The array 54 of apertures 60 can be clearly seen on the liquid level control plate 56. The flow direction of the low attenuation fluid $F_2$ between the base substrate 42 and the acoustically thin capping structure 50 can be clearly seen as well as the flow direction of the emission fluid $F_1$ between the acoustically thin capping structure 50 and the liquid level control plate 56. In FIG. 4, a length L and a width W of the array 54 can also be seen and the width W is the smaller dimension. The flow direction of the emission fluid $F_1$ is arranged such that the emission fluid 48 flows along the shorter width W of the array 54 instead of along the longer length L of the array 54. When the flow direction of the emission fluid $F_1$ is arranged to be orthogonal to the flow direction of the low attenuation fluid $F_2$, then it is preferable to arrange the flow direction of the emission fluid $F_1$ such that the emission fluid 48 flows along the shorter width W of the array 54 instead of along the longer length L because the emission fluid is more sensitive to constraining factors. For instance, small pressure deviations in the emission fluid 48 along the array 54 can lead to misdirectionality of the emitted droplets. However, in this configuration, the flow velocity of the emission fluid 48 is substantially independent of many of the constraining factors.

If, however, the droplet emitter 40 is constructed such that the flow direction of the emission fluid $F_1$ and the flow direction of the low attenuation fluid $F_2$ are substantially parallel instead of orthogonal to each other, then it is preferable that both the flow direction of the emission fluid $F_1$ and the flow direction of the low attenuation fluid $F_2$ be along the width of the array for the reasons stated above.

FIG. 5 shows a cross-sectional view of how the droplet emitter of FIGS. 3 and 4 can be assembled with a fluid manifold 62 to provide the emission fluid 48 to the droplet emitter. While unitary construction of the fluid manifold 62 may in some circumstances be desirable, in this implementation the fluid manifold 62 is divided into two portions, an upper manifold 98 and a lower manifold 92 with a flexible seal 84 therebetween.

The lower manifold 92 has a liquid level control gap protrusion 94. The liquid level control plate 56 is attached to a liquid level control gap protrusion 94. The liquid level control gap protrusion 94 is used to achieve a precise spacing between the base substrate 42 and the liquid level control plate 56 when the parts are assembled into the droplet emitter 40 and attached to the lower manifold 92.

An additional part assembled with the lower manifold 92 and the droplet emitter stack 40 is a bridge plate 82 as shown in FIG. 6. The bridge plate 82 is used to mount a flex cable 100. The flex cable 100 is used to provide connections for discrete circuit components 76 which are mounted on the flex cable 100 and are used to generate and control the focussed acoustic wave. Bond wires 96 provide electrical connections between the flex cable 100 and circuit chips 80 mounted on the base substrate 42. Control circuitry for the droplet emitter is described for instance in U.S. Pat. No. 5,786,722 by Buhler et al. titled "Integrated RF Switching Cell Built In CMOS Technology And Utilizing A High Voltage Integrated Circuit Diode With A Charge Injecting Node" issued Jul. 28, 1998, or U.S. Pat. No. 5,389,956 by Hadimioglu et al. titled "Techniques For Improving Droplet Uniformity In Acoustic Ink Printing" issued Feb. 14, 1995, both incorporated by reference herein.

FIG. 6 shows a cross-sectional view of how the droplet emitter of FIGS. 3 and 4 can be assembled with a fluid manifold 62 to provide the low attenuation fluid 52 to the droplet emitter. While unitary construction of the fluid manifold 62 may in some circumstances be desirable, in this implementation the fluid manifold 62 is again divided into two portions as described hereinabove, an upper manifold 98 and a lower manifold 92 with a flexible seal 84 therebetween.

The capping support plate 51 is positioned below the substrate 42 and sealed around the substrate in a manner such as to achieve a precise spacing between the base substrate 42 and the acoustically thin capping structure 50 when the parts are assembled into the droplet emitter 40 and attached to the lower manifold 92.

The assembly of the droplet emitter 40 and attachment to the fluid manifold 62 creates a liquid flow chamber 128 starting at the manifold inlet 120, proceeding through the gap between the base substrate 42 and the acoustically thin capping structure 50 and ending at the manifold outlet 122.

However, none of these known acoustic ink printhead configurations allow for a flowing coolant to maintain the thermal integrity of the system and an ink reservoir that does not require continuous flow. Such a configuration is desirable because the advantages of using both high viscosity inks (which do not readily flow) and flowing coolant could then be realized in a single advantageous application.

The present invention contemplates a new and improved acoustic ink printhead that attains the desired configuration and resolves the above-referenced difficulties and others.

SUMMARY OF THE INVENTION

A method and apparatus for acoustic ink printing using a bilayer printhead configuration are provided.

In one aspect of the invention, a droplet emitter device comprises a substrate having a first array of acoustic wave focussing devices positioned thereon, a plate having a second array of orifices disposed therein, the second array being aligned with the first array such that each focussing device is aligned with an orifice, a membrane positioned between the plate and the substrate, a first fluid chamber defined by the substrate and the membrane, the first fluid chamber being disposed to facilitate continuous flow of a first fluid across the first array and a second fluid chamber defined by the membrane and the plate, the second fluid chamber being disposed to maintain a stagnant volume of second fluid, the volume remaining stagnant until the second fluid is drawn from a supply upon emission of droplets of the second fluid through the orifices, such emission being dependent on generation and focussing of acoustic waves by corresponding focussing devices of the first array.

In another aspect of the invention, the first fluid is coolant.

In another aspect of the invention, the second fluid is ink.

In another aspect of the invention, a droplet emitter device comprises a substrate having a first array of lenses positioned thereon, a plate having a second array of orifices disposed therein, the second array being aligned with the first array such that each lens is aligned with an orifice, an acoustically thin membrane positioned between the plate and the substrate, a first fluid chamber defined by the substrate and the membrane, the first fluid chamber being disposed to facilitate continuous flow of a coolant across the first array and a second fluid chamber defined by the membrane and the plate, the second fluid chamber being disposed to maintain a stagnant volume of ink, the volume remaining stagnant until the ink fluid is drawn from a supply upon emission of droplets of the ink through the orifices, such emission being dependent on generation and focussing of acoustic waves by corresponding lenses of the first array.

In another aspect of the invention, a method comprises steps of facilitating a continuous flow of a coolant in the first chamber across the first array, maintaining a stagnant volume of ink in the second fluid chamber and drawing ink into the second chamber upon emission of droplets of the ink through the orifices, such emission being dependent on generation and focussing of acoustic waves by corresponding lenses of the first array.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DESCRIPTION OF THE DRAWINGS

The present invention exists in the construction, arrangement, and combination of the various parts of the device, and steps of the method, whereby the objects contemplated are attained as hereinafter more fully set forth, specifically pointed out in the claims, and illustrated in the accompanying drawings in which:

DETAILED DESCRIPTION OF THE PREFERRED EMBODIMENTS

The present invention represents an improvement over that which is known inasmuch as it provides an acoustic ink printhead, or droplet emitter device, that is effectively used with a variety of fluids and provides excellent thermal control. In this regard, the printhead finds particular application in connection with the use of high viscosity inks, e.g. hot melt inks. These inks typically present difficulties relative to thermal control, as at least partially described above, but such difficulties are overcome in the present invention by the additional use of a continuously flowing bilayer, or low attenuation, fluid.

More particularly, the invention allows for the advantageous use of high viscosity ink that is not conducive to continuous flow but instead is more conducive to storage in a standing or stagnant pool. Under typical conditions, thermal difficulties are presented by such an implementation because non-flowing ink tends to retain heat generated during operation of the printhead, which is not desired. In addition, hot melt ink requires that heat be applied to it so that it can be printed.

The printing system according to the present invention, however, also provides for the use of a continuously flowing bilayer fluid to sweep away any undesired heat generated during the operation of the printhead and retained in the ink. In this way, the printhead is thermally controlled by the bilayer fluid, which will act as a coolant in most circumstances (but may also be used to heat the ink in some circumstances).

In the preferred configuration that will be described in greater detail below, the bilayer fluid acts as an isothermal fluid that is in very close proximity to the ink and the emission array. The advantages of this feature extend beyond the cooling and thermal control referenced above. Along these lines, the mass of the printhead is reduced as a result of the use of the bilayer fluid because, where heating components are used, a reduced number thereof is necessary. Moreover, the ink is maintained at lower temperatures while being stored in the system prior to emission. Storage of high viscosity inks at lower temperatures generally results in a longer lifetime and improved stability for the ink.

It is to be understood that the above description relative to the general operation and structure of acoustic ink printing systems applies equally as well to the present invention. Any distinctions of the present invention from such known structures and techniques will be described in greater detail below.

Figure 7:
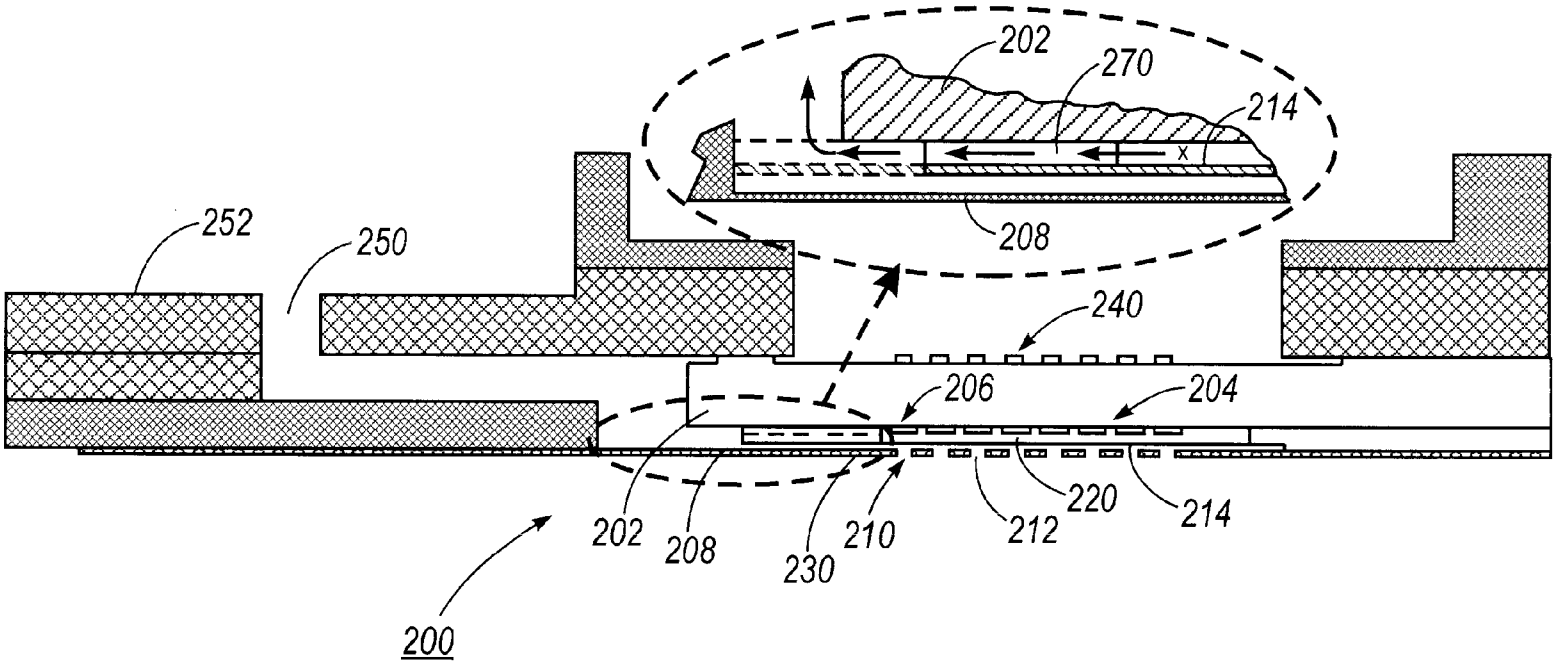
FIG. 7 shows a cross-sectional view of a droplet emitter device according to the present invention.

Referring now to the drawings wherein the showings are for purposes of illustrating the preferred embodiments of the invention only and not for purposes of limiting same, FIG. 7 provides a view of a portion of a structure of an overall preferred system according to the present invention. As shown, the droplet emitter device or acoustic ink printhead 200 comprises a base substrate 202 having an array 204 of acoustic wave focussing devices 206 positioned thereon. The devices are preferably formed of Fresnel lenses; however, any acoustic wave generation device will suffice. The emitter further includes a plate 208 having an array 210 of orifices 212 disposed therein. The plate 208 may also be referred to as a liquid level control plate. It should be understood that the lens or focussing device array 204 is aligned with the orifice array 210 such that each focussing device or lens 206 is aligned with an orifice 212. As such, a plurality of individual emitters (comprising a lens, orifice and transducer) form an emitter, or emission, array.

Figure 1:
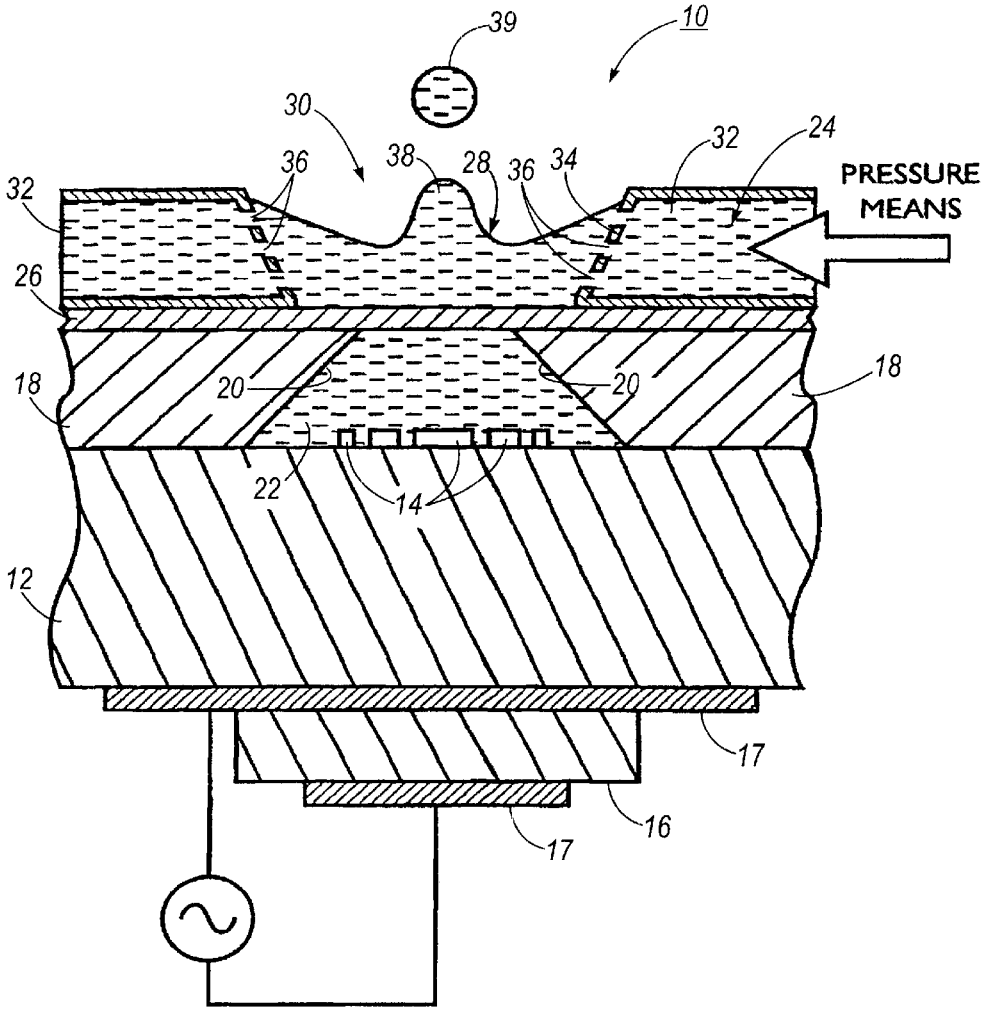
FIG. 1 (Prior Art)
FIG. 1 shows a cross-sectional view of a prior art droplet emitter for an acoustically actuated printer.
Figure 2:
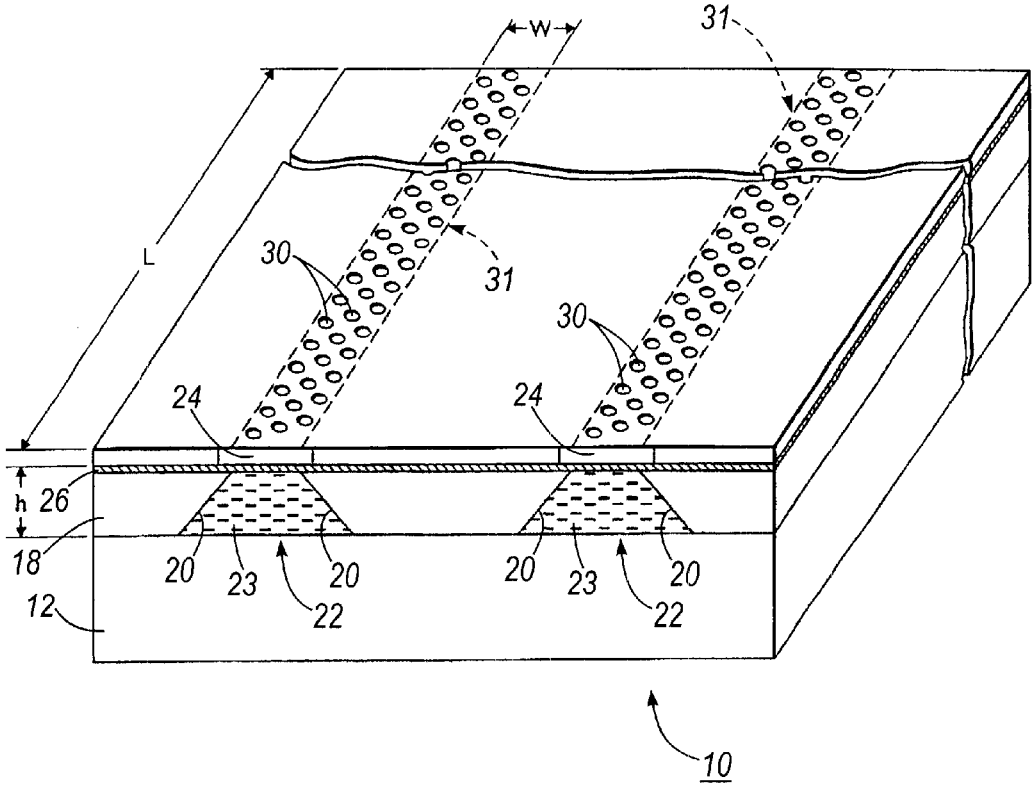
FIG. 2 (Prior Art)
FIG. 2 shows a perspective view of arrays of prior art droplet emitters shown in FIG. 1.
Figure 3:
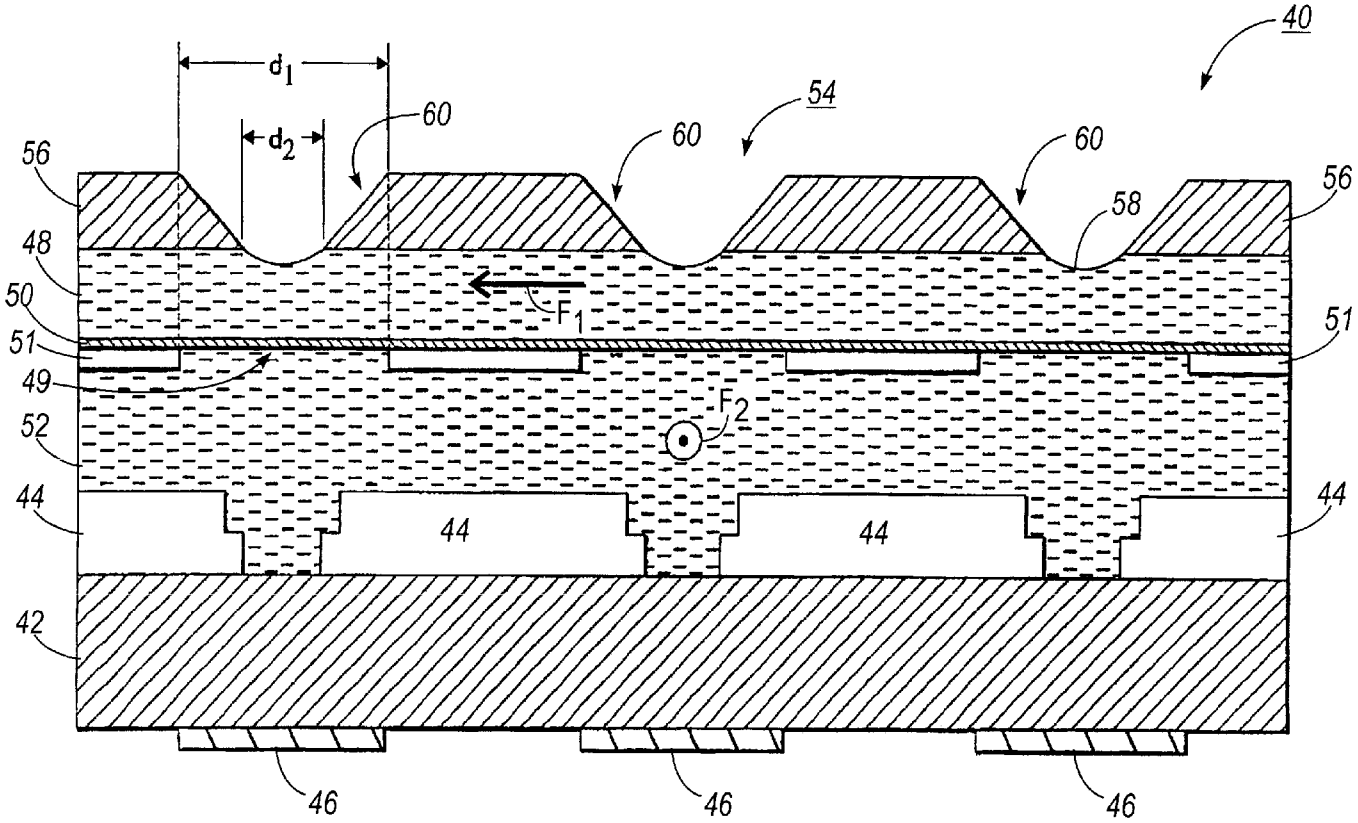
FIG. 3 show a cross-sectional view of prior art droplet emitters.
Figure 4:
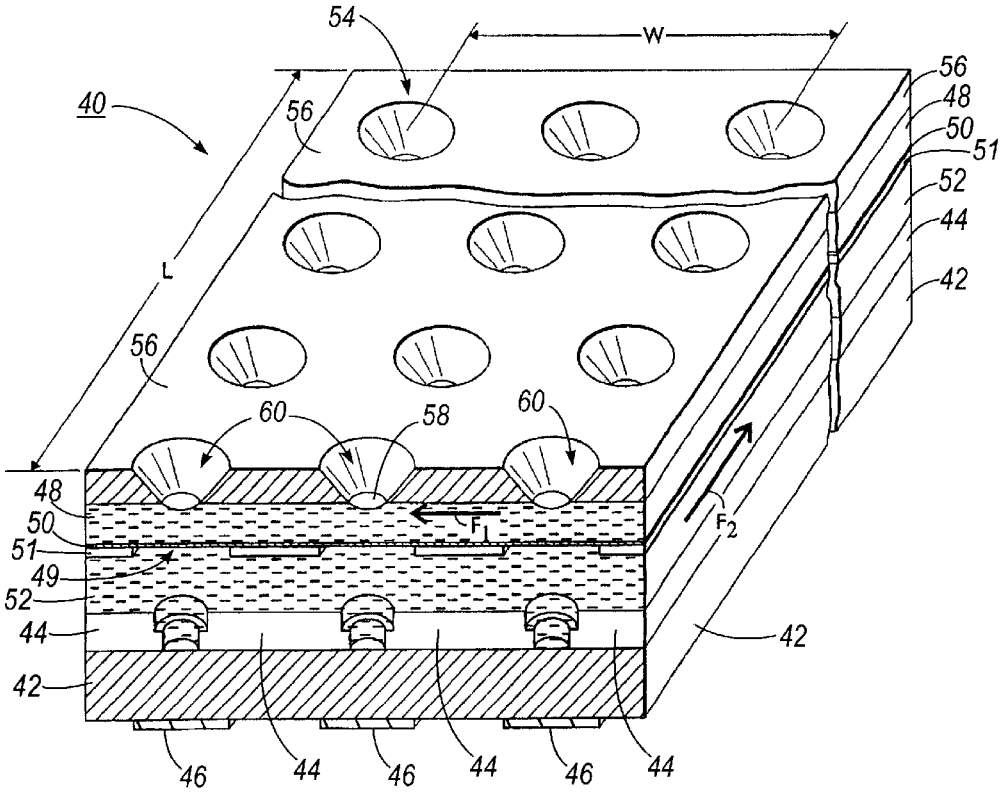
FIG. 4 shows a perspective view of the droplet emitter device shown in FIG. 3.
Figure 5:
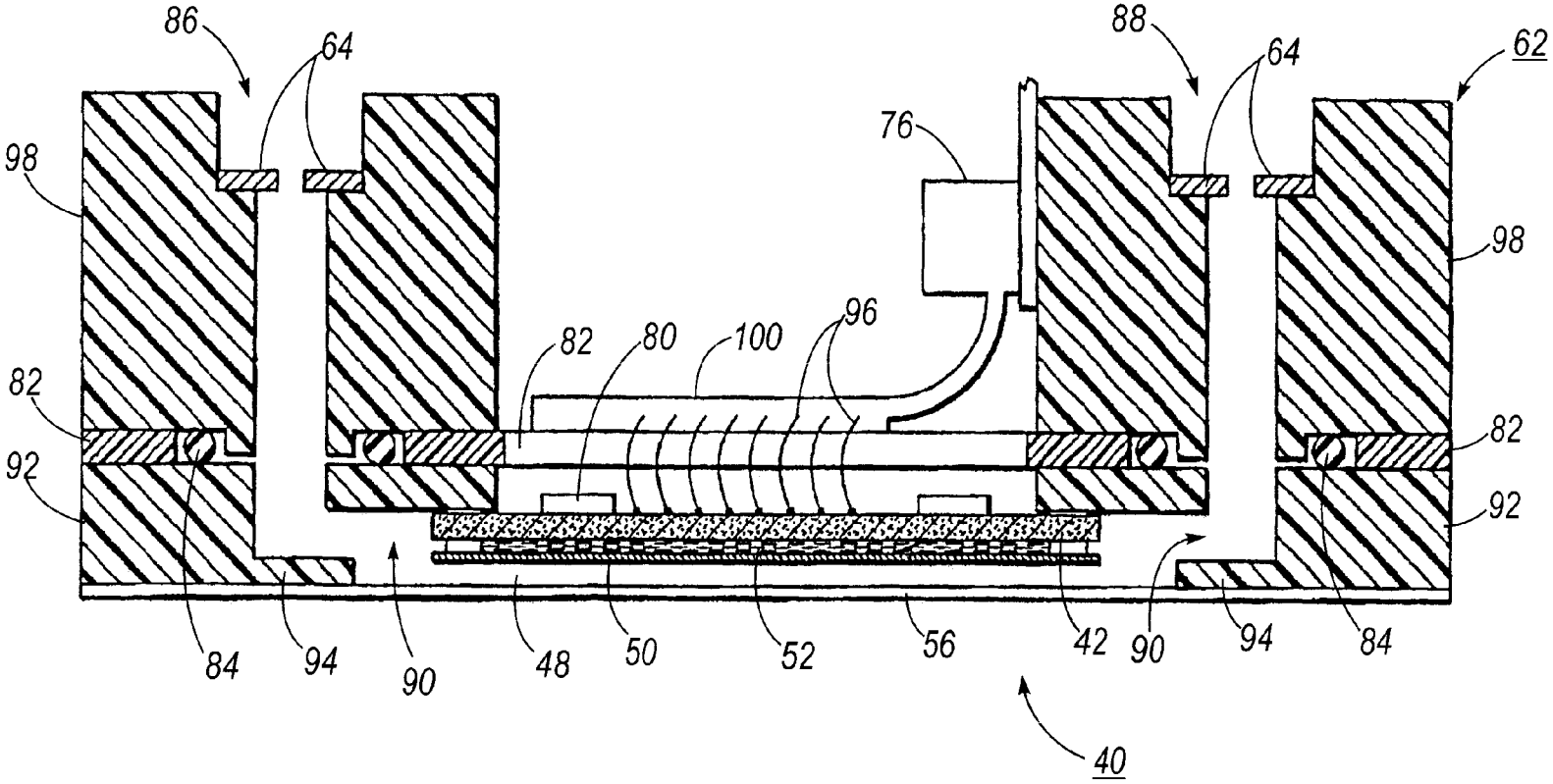
FIG. 5 shows a cross-sectional view of the droplet emitter device shown in FIG. 3 with an emission fluid manifold attached.
Figure 6:
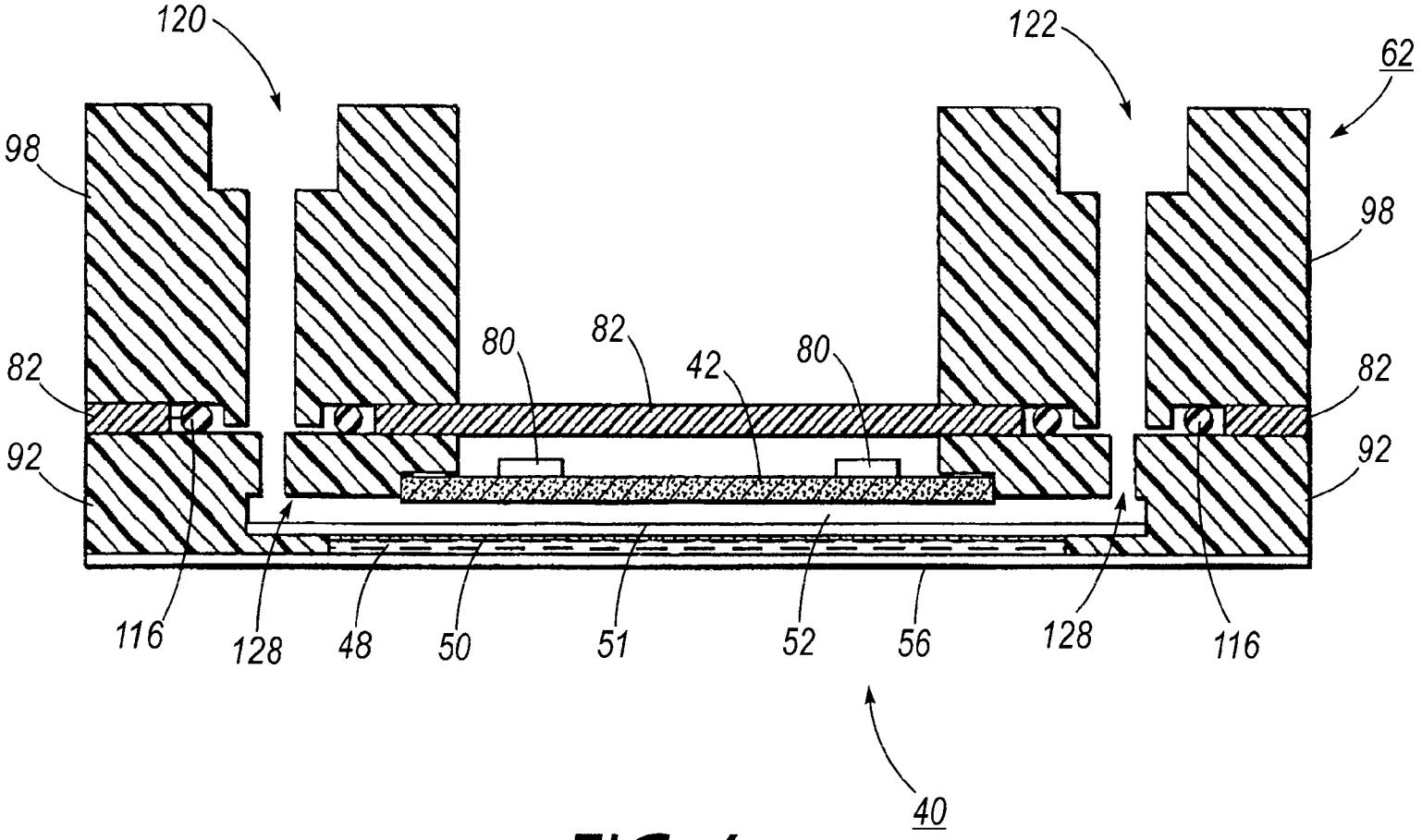
FIG. 6 shows a cross-sectional view of the droplet emitter device shown in FIG. 3 with a low attenuation fluid manifold attached.

Also shown in FIG. 7 is a membrane, or capping structure, 214 positioned between the plate 208 and the substrate 202. Preferably, the membrane 214 is acoustically thin. Acoustically thin is generally meant to define structures that have a wavelength that is less than the wavelength of the waves that will propagate therethrough. In this way, the membrane will not impede the propagation of waves that are transmitted from the lens through the membrane to be focussed at the surface of the ink. Although not shown in FIG. 7, it is to be appreciated that the membrane may also be provided with support structures similar to those that are shown in FIGS. 3–4.

Importantly, a first fluid chamber 220 is defined by the substrate 202 and the membrane 214. The first fluid chamber 220 is to facilitate continuous flow of a first, or bilayer, fluid across the lens array 214. In this regard, the first fluid is preferably a low attenuation fluid or coolant such as water (for aqueous inks) or diethylene glycol (for phase change inks). However, any fluid that is of low viscosity that has sufficient heat dissipation properties will suffice. The direction of flow of the bilayer fluid will be described in greater detail in connection with FIGS. 9 and 10.

A second fluid chamber 230 is defined by the membrane 214 and the plate 208. The second fluid chamber 230 is to maintain a substantially stagnant volume of a second fluid. Preferably, the second fluid is an emission fluid such as ink. The volume of ink remains generally stagnant in the second chamber until such time as the ink is drawn from an ink supply or reservoir that is provided for the system. In this embodiment of the invention, the drawing of ink occurs upon emission of droplets of the ink through the orifices 212. It shall be understood that the emission is dependent on generation and focussing of acoustic waves by corresponding focussing devices or lenses.

Also shown in FIG. 7 are transducers 240 that are positioned on a side opposite the lenses 206 on the substrate 202. It is to be appreciated that the transducers preferably generate the acoustic waves that propagate through the substrate 202 and are focussed by the lenses 206 to ultimately emit droplets of ink through the orifices 212.

The printhead 200 further includes an ink delivery channel 250 that is defined in a manifold structure 252. Preferably, the ink channel 250 provides ink to the chamber 230 from a suitable ink reservoir (not shown) in the system. The ink is provided in a laminar form to accommodate the fine width of the ink chamber. However, the ink is not recirculated. The ink is simply stored in the chamber and replaced as droplets are emitted from the chamber. In this regard, the capillary forces in each ink orifice meniscus facilitate the refilling, or replacement, after ink is removed during drop emission.

Also shown in FIG. 7 is an enlarged view of a portion of the structure that is not seen in the non-enlarged portion of FIG. 7 (but represented by a dotted line). In this regard, the enlarged view shows a different cross-section than the non-enlarged portion of FIG. 7 (e.g. rearwardly spaced from the cross-section thereof) and illustrates an exemplary channel 270 that facilitates flow for the first fluid in the chamber 220 in the direction of the arrow X. It should be appreciated that the channel 270 communicates with, for example, a port 264 (shown in FIGS. 8 and 9 as an outlet port). For inlet ports, such as port 260, the direction of flow is reversed.

It is to be appreciated that the portion of the printhead shown in FIG. 7—showing only eight rows of emitters—is approximately one-half of a larger printhead having sixteen rows of emitters. Of course, that which is shown could constitute a full array for a printhead of smaller dimension. However, in cases where sixteen rows of ejectors are desired, the embodiment as shown would include a nearly identical and complementary portion of the printhead extending from the substrate 202 to another array of emitters and corresponding structure. It is to be appreciated that a separate manifold is also provided on the opposite side of the printhead. It should be further understood that the ink chamber does not extend over to the opposite array because sufficient support structures must be provided to the orifice plate between the two arrays of emitters. Therefore, a separate ink chamber is provided to the emitter array provided on the opposite side (but not shown) and no ink flows between the two chambers. Of course, in the event that a sufficiently stable orifice, or liquid level control, plate could be provided to the printhead such that no support would be required to accommodate sixteen rows of emitters, then the possibility exists that a single ink chamber and manifold could facilitate delivery of ink to both arrays. This is not the case in the preferred configuration of the printhead, however.

Figure 8:
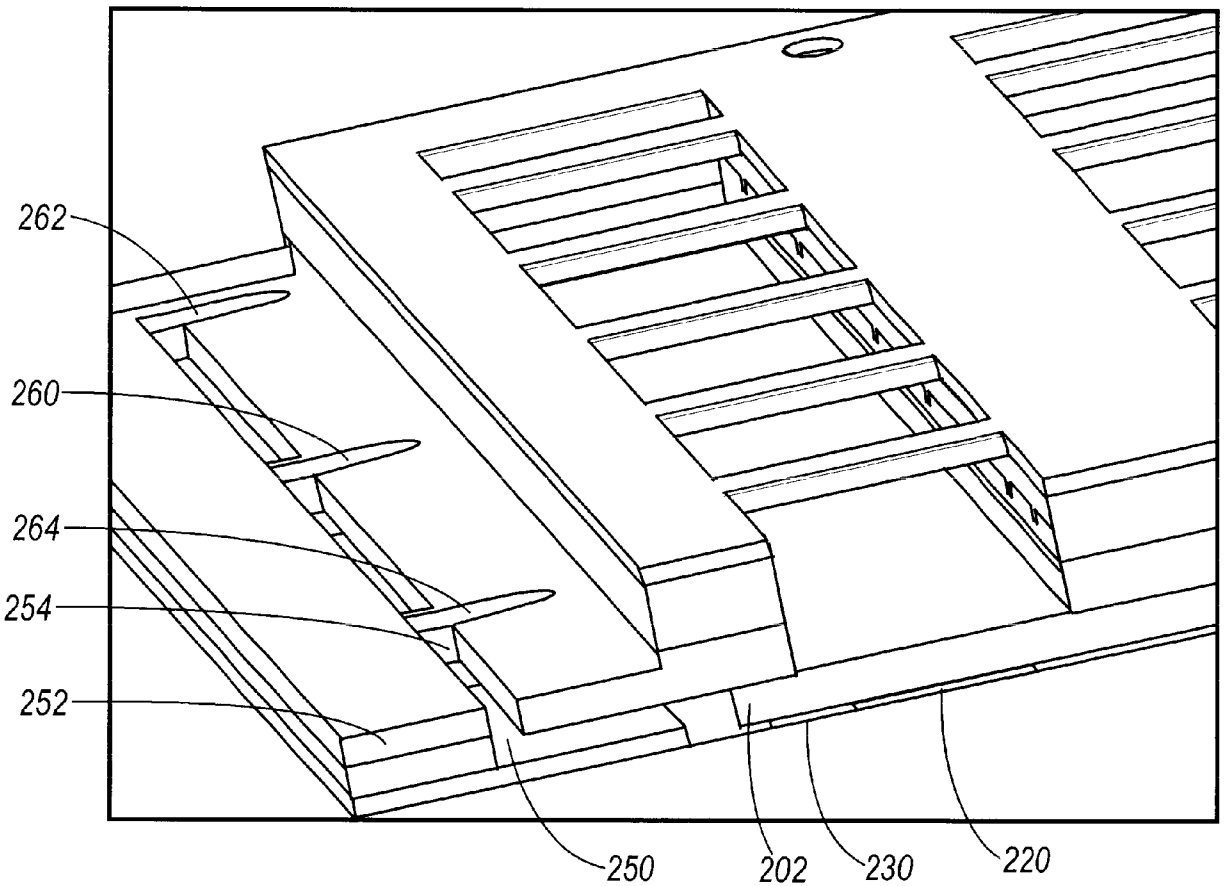
FIG. 8 shows a perspective view of the droplet emitter device of FIG. 7.

Referring now to FIG. 8, a perspective view of the printhead 200 reveals that the ink channel 250 of the manifold 252 has a slot-like opening 254 that is operative to communicate with an ink supply (not shown). In addition, the first chamber is provided with a port 260 that serves as an inlet for the coolant that is maintained and circulated through the first chamber 220. Likewise, ports 262 and 264 that act as outlets for coolant in the embodiment shown are provided along the same side of the emitter array as the inlet port 260. It is to be appreciated that inlet and outlet ports alternate along the length of the emitter array. It should also be understood that the inlet and outlet ports are operative to communicate with suitable manifold structure (not shown) to provide a continuous flow of the coolant to the first chamber and suitable coolant flow structure (not shown) associated with the printhead to allow for recirculation of the coolant through the printhead system.

Along the recirculation path, those of skill in the art will understand that suitable thermal control devices may be provided to control the temperature of the coolant. Of course, in the preferred form, the first fluid is a coolant that reduces the temperature of the emission arrays during operation. Therefore, the thermal control elements that may be utilized along the recirculation path would take the form of cooling structures. However, there may exist circumstances wherein the preference would be to provide heating structures along the recirculation path in order to accommodate heating of the printhead (and consequently heating the emission fluid, e.g. hot melt ink) as well. In some forms of the invention, the bilayer fluid alone controls the thermal characteristics of the printhead, without additional structures.

Figure 9:
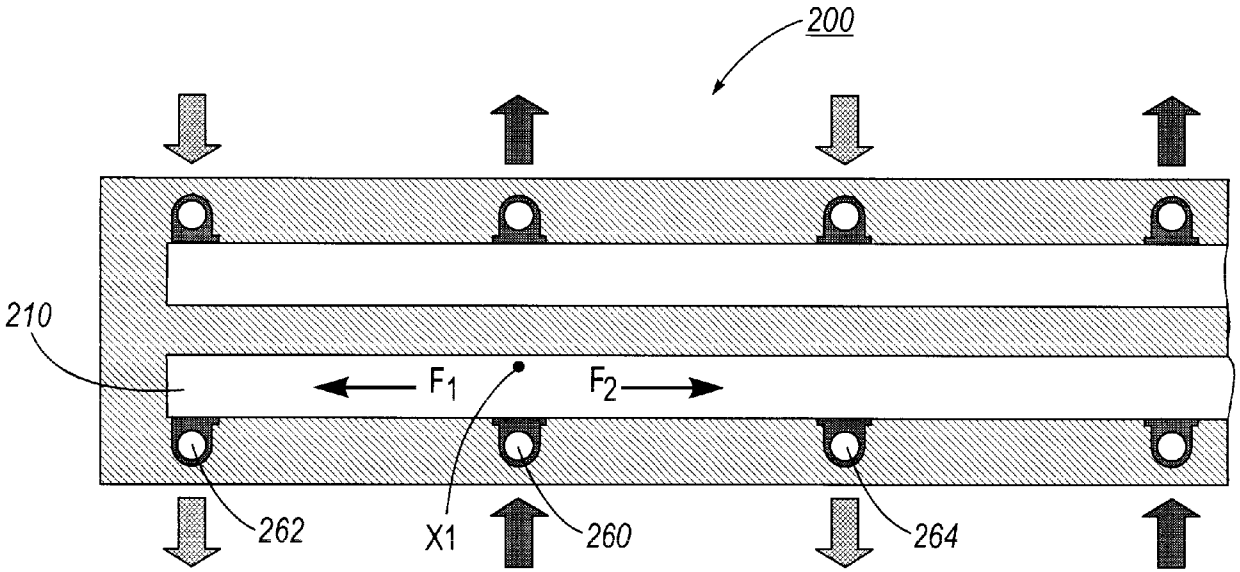
FIG. 9 shows a top view of the droplet emitter device of FIG. 7.

In FIG. 9, a top view of the printhead with the orifice plate and membrane removed shows that the inlet port 260 provides fluid to the first chamber 220. The fluid provided flows in the directions F1 and F2 to the nearest outlet ports 262 and 264, respectively. As shown, the flow directions are preferably substantially along the length of the printhead, except when in proximity to the inlet and outlet ports. Thus, the flow is substantially "U" shaped in the first chamber. Of course, these flow paths are replicated along and across the entire printhead. Once the fluid exits the chamber through ports 262 and 264, it is recirculated through the system. The continuous flow of fluid in this manner provides for thermal control of the printhead.

As is apparent from the embodiment shown in FIG. 9, the substantially "U" shaped flow paths result from the fact that the structure of the sixteen row embodiment provides for a support structure disposed between the arrays of eight rows of emitters. As a consequence, it is not possible to achieve continuous flow from one side of the printhead to the other in the direction of the width of the printhead.

Figure 10:
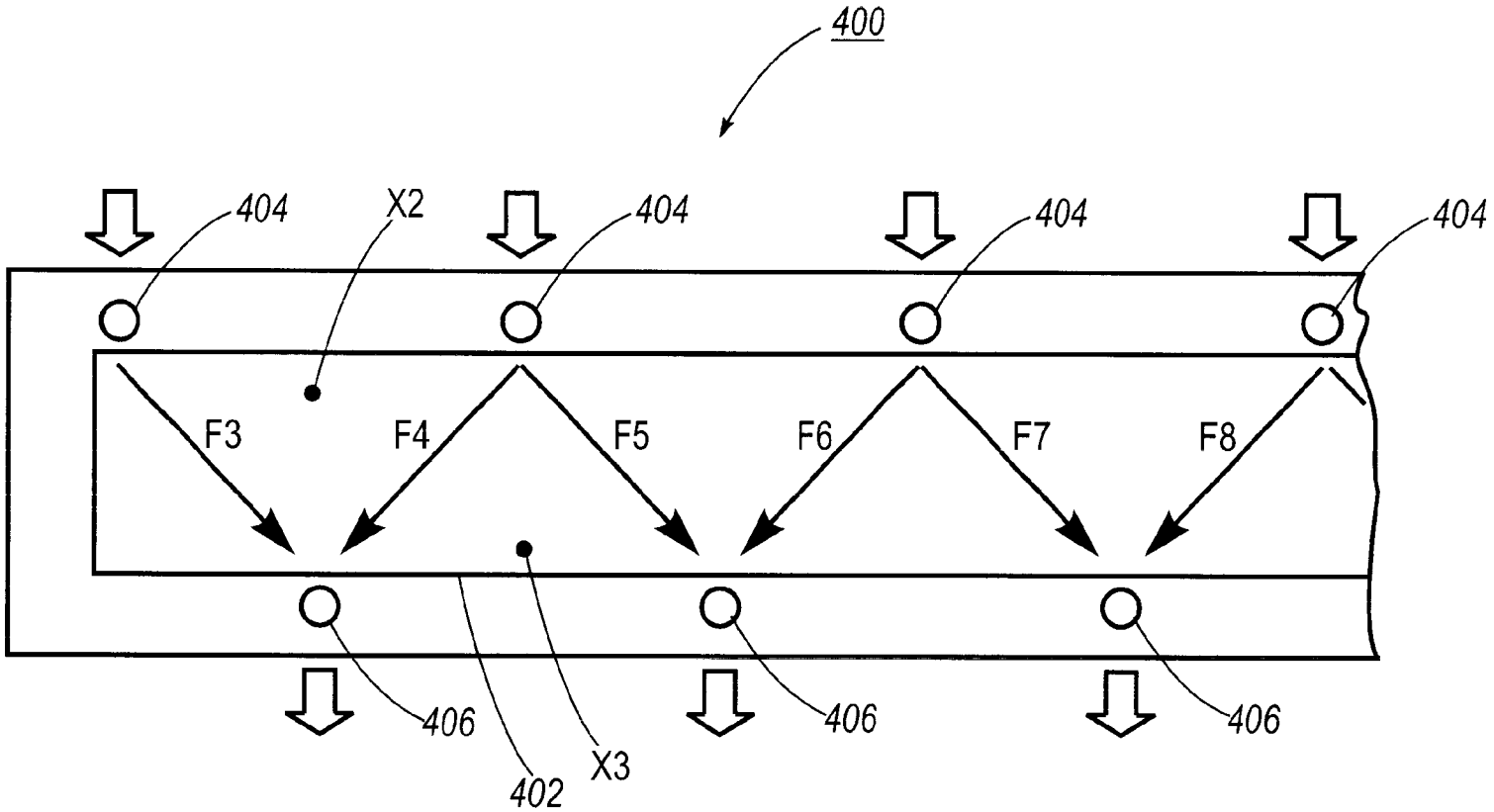
FIG. 10 shows a top view of an alternative droplet emitter device according to the present invention.

In an alternative embodiment of the invention, however, only a single eight row array of emitters is utilized. Thus, as shown in FIG. 10, a printhead 400 (in a similar view to that of FIG. 9) includes a single, eight row array of emitters 402. For convenience, the emitters are not specifically shown. In this configuration, inlet ports 404 are provided on one side of the array 402 and outlet ports 406 are provided on the opposite side of the array. The fluid that is input to the chamber flows continuously along the flow lines illustrated, e.g. F3, F4, F5, F6, F7 and F8. As can be seen, the flow of liquid is fanned from each inlet port to provide a laminar supply of fluid to the chamber. It then egresses from the chamber at the various suitable outlet ports and recirculated, as described above.

In either the embodiment shown in FIG. 9 or FIG. 10, consideration is preferably given to areas between the inlet and outlet ports that may be impacted by curving flow lines in such a way so as to result in zones where no fluid is actually flowing, so-called "stagnant zones." Although in the ink chamber, the pool of ink is preferably stagnant (except when ink is being replaced), it is preferred that no area in the first chamber covering the emitter array be stagnant. Stagnant flow results in a lack of cooling of the area. As such, potentially stagnant zones such as those referenced by X1 in FIG. 9 and X2 and X3 in FIG. 10 are preferably avoided in determining the dimensions and placement of the components of the printhead. Thus, the flowing fluid should be, for example, fanned out to prevent stagnation. If such zones cannot altogether be avoided in a given design, then any such stagnant zones should be restricted to areas in the chamber that do not impact the emitter array, such as along edges where no emitters are positioned.

In this regard, other relevant considerations include the number of emitters implemented in the array(s) and spacing of inlet ports and outlet ports, relative to one another and the emitter array. It is also desired that the flow paths, wherever located, provide unimpeded flow lines so that the cooling fluid can travel at a velocity sufficient to remove the heat so the printhead can be effectively cooled.

As a part of the implementation, it should be understood that only a fixed amount of space within the printer is available in which to position the printhead and any associated structures. At the same time, however, the printhead must be of a sufficient size so as to include relevant elements such as inlet and outlet ports for both the emission fluid and the bilayer fluid.

The considerations discussed thus generally impact the length and width of the printhead. However, the height of the printhead is also a function of operating characteristics of the system. Along these lines, the dimensions of the fluid that is supplied to the printhead arrays in laminar form are factors. Those of skill in the art will appreciate that implementing a printhead that takes this into account implicates a variety of design trade-offs. For example, if the ink is too thin, a pressure gradient may be created in the system which will effect the meniscus offset and adversely impact the power uniformity of the system. Conversely, if the bilayer fluid is provide in a sheet that is too thin, a temperature gradient may occur in the system. This, too, will create a power nonuniformity.

As an example, for a printhead having 8 rows of emitters to be used with a phase change ink having a viscosity of approximately 12 centipois, the chamber for the first and second fluids should be approximately 5 mils (0.05 inches) in height. In the eight row version, the distances between inlets ports and outlet ports is preferably 5–10 mm. The resultant emitted drops preferably have a volume of 2 picoliters and can be emitted at a frequency of 25 kilohertz.

The above description merely provides a disclosure of particular embodiments of the invention and is not intended for the purposes of limiting the same thereto. As such, the invention is not limited to only the abovedescribed embodiments. Rather, it is recognized that one skilled in the art could conceive alternative embodiments that fall within the scope of the invention.

Having thus described the invention, we hereby claim:

1. A droplet emitter device comprising:

a substrate having a first array of acoustic wave focussing devices positioned thereon;

a plate having a second array of orifices disposed therein, the second array being aligned with the first array such that each focussing device is aligned with an orifice;

a membrane positioned between the plate and the substrate;

a first fluid chamber defined by the substrate and the membrane, the first fluid chamber being disposed to facilitate continuous flow of a first fluid across the first array; and, a second fluid chamber defined by the membrane and the plate, the second fluid chamber being disposed to maintain a stagnant volume of second fluid, the volume remaining stagnant until the second fluid is drawn from a supply upon emission of droplets of the second fluid through the orifices, such emission being dependent on generation and focussing of acoustic waves by corresponding focussing devices of the first array.

2. The droplet emitter device as set forth in claim 1 wherein the first fluid is coolant.

3. The droplet emitter device as set forth in claim 1 wherein the second fluid is ink.

4. The droplet emitter device as set forth in claim 1 wherein the acoustic wave generating devices comprise lenses.

5. The droplet emitter device as set forth in claim 4 wherein the lenses are Fresnel lenses.

6. The droplet emitter device as set forth in claim 1 wherein the membrane is acoustically thin.

7. The droplet emitter device as set forth in claim 1 further comprising a manifold in communication with the first fluid chamber, the manifold comprising inlet and outlet ports that facilitate the continues flow of first fluid across the first array.

8. The droplet emitter device as set forth in claim 7 wherein the substrate has a length and a width and further wherein the continuous flow is in a direction substantially along the length of the substrate.

9. The droplet emitter device as set forth in claim 7 wherein the substrate has a length and a width and further wherein the continuous flow is in a direction substantially along the width of the substrate.

10. A droplet emitter device comprising:

a substrate having a first array of lenses positioned thereon;

a plate having a second array of orifices disposed therein, the second array being aligned with the first array such that each lens is aligned with an orifice;

an acoustically thin membrane positioned between the plate and the substrate;

a first fluid chamber defined by the substrate and the membrane, the first fluid chamber being disposed to facilitate continuous flow of a coolant across the first array; and, a second fluid chamber defined by the membrane and the plate, the second fluid chamber being disposed to maintain a stagnant volume of ink, the volume remaining stagnant until the ink fluid is drawn from a supply upon emission of droplets of the ink through the orifices, such emission being dependent on generation and focussing of acoustic waves by corresponding lenses of the first array.

11. The droplet emitter device as set forth in claim 10 further comprising a manifold in communication with the first fluid chamber, the manifold comprising inlet and outlet ports that facilitate the continues flow of first fluid across the first array.

12. The droplet emitter device as set forth in claim 11 wherein the substrate has a length and a width and further wherein the continuous flow is in a direction substantially along the length of the substrate.

13. The droplet emitter device as set forth in claim 11 wherein the substrate has a length and a width and further wherein the continuous flow is in a direction substantially along the width of the substrate.

14. The droplet emitter device as set forth in claim 11 wherein the lenses are Fresnel lenses.

15. A method for emitting droplets of ink from a droplet emitter device including a substrate having a first array of lenses positioned thereon, a plate having a second array of orifices disposed therein, the second array being aligned with the first array such that each lens is aligned with an orifice, an acoustically thin membrane positioned between the plate and the substrate, a first fluid chamber defined by the substrate and the membrane, a second fluid chamber defined by the membrane and the plate, the method comprising steps of:

facilitating a continuous flow of a coolant in the first chamber across the first array;

maintaining a stagnant volume of ink in the second fluid chamber; and, drawing ink into the second chamber upon emission of droplets of the ink through the orifices, such emission being dependent on generation and focussing of acoustic waves by corresponding lenses of the first array.

* * * * *